US005733432A

United States Patent [19]

Williams et al.

[11] Patent Number: 5,733,432

[45] Date of Patent: Mar. 31, 1998

[54] CATHODIC PARTICLE-ASSISTED ETCHING OF SUBSTRATES

[75] Inventors: Ronald L. Williams, Fallbrook; James C. Thomas, Santa Barbara, both of Calif.

[73] Assignee: Hughes Electronics, Los Angeles, Calif.

[21] Appl. No.: 703,750

[22] Filed: Aug. 27, 1996

[51] Int. Cl.[6] ..... C25F 3/14

[52] U.S. Cl. ..... 205/657; 205/666; 205/674

[58] Field of Search ..... 205/657, 666, 205/674

[56] References Cited

U.S. PATENT DOCUMENTS 2,052,962 9/1936 Booe ..... 205/657

3,539,408 11/1970 Cashau et al. ..... 205/657 X 4,836,888 6/1989 Nojiri et al. ..... 205/657 X

*Primary Examiner*—Donald R. Valentine

*Attorney, Agent, or Firm*—W. C. Schubert; W. K. Denson-Low

[57] ABSTRACT

An electrically conductive substrate (20) is etched by providing an etchant solution having finely divided, electrically conductive particles (40) mixed therein. The electrically conductive particles (40) are made of a material that is cathodic to the substrate (20) and does not dissolve into the etchant solution, with a preferred such material being graphite. The substrate (20) is placed into the etchant solution having the particles (40) therein so that the particles (40) contact the substrate (20), and etched for a period of time sufficient to remove a desired amount of the substrate material. The substrate (20) may be provided with an apertured mask (24) prior to being placed into the etchant solution.

14 Claims, 2 Drawing Sheets

CATHODIC PARTICLE-ASSISTED ETCHING OF SUBSTRATES

BACKGROUND OF THE INVENTION

This invention relates to the etching of substrates, and, more particularly, to such etching accomplished in the presence of finely divided, electrically conductive particles.

Etching is a process by which material is controllably removed from the surface of a substrate, either uniformly or selectively as desired. Etching may be accomplished in a purely chemical manner, wherein the substrate is placed into a reactive etchant solution that reactively dissolves material from the surface of the substrate. Etching may be accomplished electrochemically, wherein the substrate is placed into an electrically conductive solution and made the anode of an etching cell, so that material is electrochemically removed from the substrate. Etching may also be accomplished by dry techniques such as plasma etching, as distinct from the wet chemical and electrochemical techniques.

One of the important applications of etching is the removal of material from the apertured regions of a masked substrate. A mask such as a layer of a photoresist material is applied to the surface of the substrate, and an aperture is defined and opened through the mask. The masked face of the substrate is contacted to the etching medium, and material is removed from the portion of the substrate exposed through the aperture. This technique, in a number of variations, is widely used in microelectronic device fabrication and other processes.

Ideally, such an approach removes the substrate material much more rapidly than it does the mask material, and produces a straight-sided recess in the surface of the substrate below the mask. If the rate of removal of the mask material approaches that of the substrate material, the mask must be quite thick, leading to a reduction of resolution of etched features that may be obtained. If the temperature of the etchant is raised to increase the etching rate of the substrate, the etching rate of the mask is also raised and there is usually no improvement in the available resolution.

Moreover, a major problem experienced in the chemical and electrochemical etching removal of material from masked substrate is undercutting of the mask. That is, the region of the substrate under the mask but immediately adjacent to the aperture may be attacked and removed in the etching operation. The result is that the recess does not have straight sides, but instead has sloped sides such that the bottom of the recess is of a smaller lateral size than the top of the recess. If, as is often the case in microelectronic device fabrication, the mask is removed and additional layers are deposited overlying the etched substrate, the newly deposited layers experience a set-back effect due to the sloped sides of the recess.

Dry etching techniques typically suffer less undercutting of the mask than do the chemical and electrochemical approaches, and in some cases dry etching techniques have replaced the more conventional etching procedures in production operations. Dry etching techniques are more expensive and often accomplish the etching more slowly than the wet chemical techniques, and are less suited for large-scale commercial production of microelectronic devices.

There is a need for an improved approach to the etching of substrates, particularly those having masked and apertured surfaces. The present invention fulfills this need, and further provides related advantages.

SUMMARY OF THE INVENTION

The present invention provides an improved wet etching technique which produces more rapid etching of substrates than does conventional wet etching techniques. The etching rate of the substrate material relative to the mask material is increased, allowing the use of a thin mask that leads to a high resolution of the etched features. The approach also significantly reduces undercutting of the mask. The etching rate is asymmetric under and adjacent to the mask, with the deepening of the etch recess being at a higher rate, typically at least four times higher, than the widening of the recess under the periphery of the aperture in the mask. The etched recess produced by the present approach is therefore bounded by more nearly vertical sides, with a size and shape defined by the aperture in the mask, than the etched recess produced by a conventional approach.

In accordance with the invention, a method for etching a substrate comprises the steps of providing an electrically conductive substrate, providing an etchant solution, and adding finely divided, electrically conductive particles, preferably graphite particles, to the etchant solution. The electrically conductive particles are made of a material that is cathodic to the substrate on a galvanic series and does not dissolve into the etchant solution. The method further includes placing the substrate into the etchant solution having the electrically conductive particles therein, and maintaining the substrate in contact with the etchant solution having the electrically conductive particles therein for a period of time.

In a preferred embodiment, the substrate includes an apertured mask thereover. The aperture defines an opening through which the substrate is etched, with the intention that only the area under the aperture is etched and the surrounding portions of the substrate are not etched. The present approach is highly successful at achieving a substrate having an etched recess with walls that are generally perpendicular to the surface of the substrate and having the shape and size defined by the mask.

The present approach achieves an increased rate of etching downwardly into the substrate, on the order of four times as fast as achieved when the finely divided particles are not present. Consequently, either shorter etching times at a fixed temperature or lower etching temperatures, may be used. This increased etching rate at a selected temperature leads to improved resolution of etched features, a significant advantage. The mask (whose etching rate is unaffected by the presence of the particles) may be made relatively thinner without being removed prior to the completion of the etching of the substrate, thereby permitting higher resolution of the features of the substrate. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
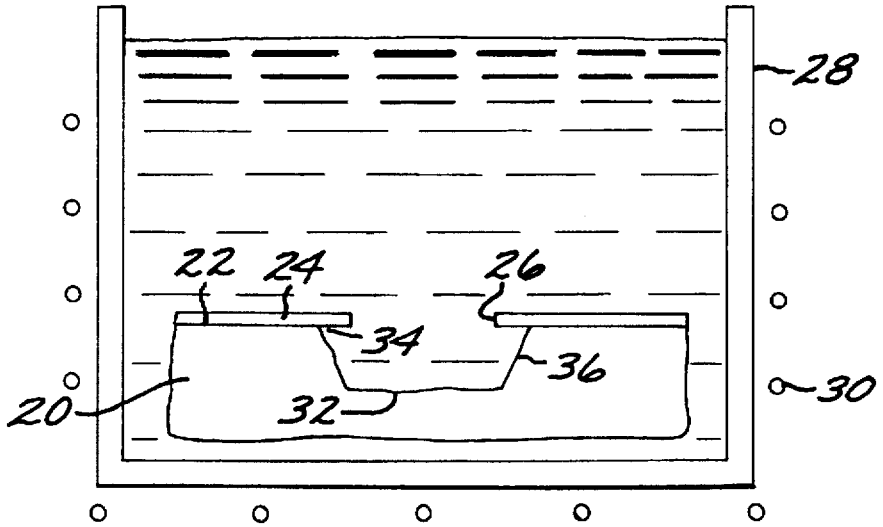
FIG. 1 PRIOR ART
FIG. 1 is a schematic sectional view of a prior art etching process.

FIG. 1 illustrates a prior approach to the etching of a substrate 20. The substrate 20 is in this case a piece of silicon with a surface 22 having a mask 24 thereon with an aperture 26 therethrough. The mask and aperture are formed by any operable technique. In the preferred approach, a layer of a photosensitive polymer (termed a photoresist) is spread over the surface. The polymer is selectively exposed to light to define the aperture and developed, so that the portion of the photosensitive polymer outside the aperture area is transformed to be resistant to removal by the etchant solution. The untransformed region within the aperture is removed, as in a selective solution. Such photoresist materials and techniques are well known and widely used.

An etchant solution is provided. The etchant solution is selected to chemically react with, attack, and remove the material of the substrate. The composition of the etchant solution is typically selected to achieve the removal at a relatively slow rate so that the depth of material removal is controllable. In the case of the silicon substrate, the preferred etchant is an aqueous 10 percent potassium hydroxide solution.

The etchant solution is placed into an appropriate container, here illustrated as a beaker 28. In the preferred case, the potassium hydroxide solution is heated with a heater 30 to a temperature of at least about 60° C. or higher to increase the rate of removal of silicon. The masked substrate 20 is placed into the beaker 28 with the aperture 26 below the surface of the liquid etchant solution.

Over a period of time, the etchant solution attacks and removes the substrate material in the region that is exposed through the aperture 26 of the mask 24, forming a recess 32. The removal of substrate material causes the recess 32 to deepen, but also to widen to form an undercut 34. The result is that the sides 36 of the recess 32 are inwardly sloped from top to bottom, with the recess assuming the shape of an inverted, truncated cone (for the case of a generally circular aperture 26). The sloping sides of the recess 32 are undesirable for a number of reasons. The shape of the recess becomes somewhat uncontrolled, and the geometry of any overlying layers and features is limited by the lateral extent of the undercut 34.

Figure 2:
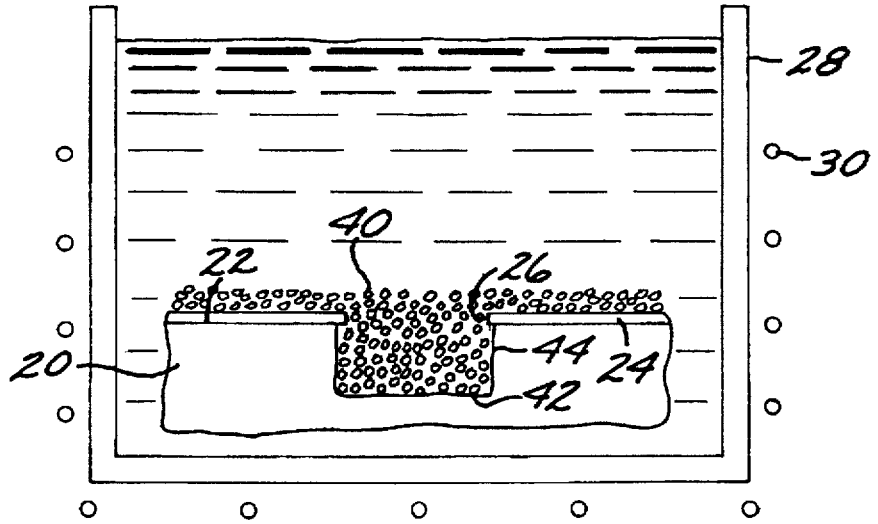
FIG. 2 is a schematic sectional view of the present etching process using a chemical etching approach.

In the present approach, shown in FIG. 2, many of the elements are the same as discussed above in relation to FIG. 1. Those common elements are commonly numbered, and their description is incorporated herein.

In the present approach, a plurality of finely divided, electrically conductive particles 40 are present in the etchant solution. The electrically conductive particles are made of a material that is cathodic to the substrate 20 on a galvanic series, and do not dissolve into the etchant solution. When the substrate 20 is oriented with the mask 24 facing upwardly, the particles 40 settle onto the mask 24 and the aperture 26. Those particles 40 which settle onto the aperture 26 contact the surface of the substrate 20, rather than the mask material.

It has been found that the presence of the particles 40 increases the rate of etching (i.e., removal of material downwardly from the surface of the substrate), on the order of about a factor of four as compared with the case shown in FIG. 1 wherein no particles 40 are present. Simultaneously, the presence of the particles 40 reduces the tendency for undercutting, so that the sides 42 of a recess 44 formed under the aperture 26 are more nearly vertical (i.e., perpendicular to the surface 22 of the substrate). In the present approach, there is little if any undercutting observed.

As discussed, the particles 40 are selected to be of a material that is cathodic to the substrate 20 on the galvanic series, and do not dissolve into the etchant solution. A galvanic series is a ranking relation, usually expressed as a chart, of the electrical potentials of various substances in a selected liquid medium. The relative ranking of many materials in a galvanic series is well known in the art and widely available. A galvanic series is typically available as a standard reference for materials in pure water or sea water. Although the etching solution is not seawater, similar relative rankings of various materials in sea water are maintained in etchant solutions such as potassium hydroxide solution. Materials with the largest negative (i.e., largest absolute value, but negative) corrosion potential (in volts) have the highest corrosion rates, and are termed the most anodic. Materials with the smallest negative (i.e., smallest absolute value, but negative) or positive corrosion potential have the lowest corrosion rates, and are termed the most cathodic. More-cathodic materials are more noble than more-anodic materials, and therefore less likely to be attacked by the etchant.

To determine operable particles 40, the position of the substrate 20 on the galvanic series is found. Operable particles 40 are those that are made of a material that is more cathodic than the material of the substrate. The relative rankings of a candidate substrate material and a candidate particle material are either obtained from an available galvanic series or measured by well known measurement techniques. The relative ranking, not the precise potentials, must be determined. Additionally, the particles cannot be attacked and dissolved in the etchant solution, or they would disappear and their effect be lost.

A readily available particle that meets these requirements in a wide range of situations is an electrically conductive form of carbon, and in particular graphite. Graphite has a corrosion potential of from about −0.20 volts to about +0.30 volts in seawater, which is more cathodic than virtually any other electrically conductive material that is commonly available in finely divided particulate form. Additionally, graphite particulate material is available commercially in a wide range of sizes and at modest cost. Finally, graphite is inert in common acid and alkaline solutions that are most often used as etchant solutions. Graphite is therefore the most preferred particulate material 40.

The particle size can be varied over a wide range, with the preferred particle size being from about 0.0005 to about 0.003 inches in diameter. The particles are preferably of about the same size, but a distribution of sizes is acceptable and operable. The particles are preferably roughly equiaxed, but need not be spherical, cubic, or any other exact equiaxed form. It is preferred that the particles be as small as practical for any selected etching application, because smaller particles tend to contact the surface being etched more often and physically interact with each other less than do larger particles.

Figure 3:
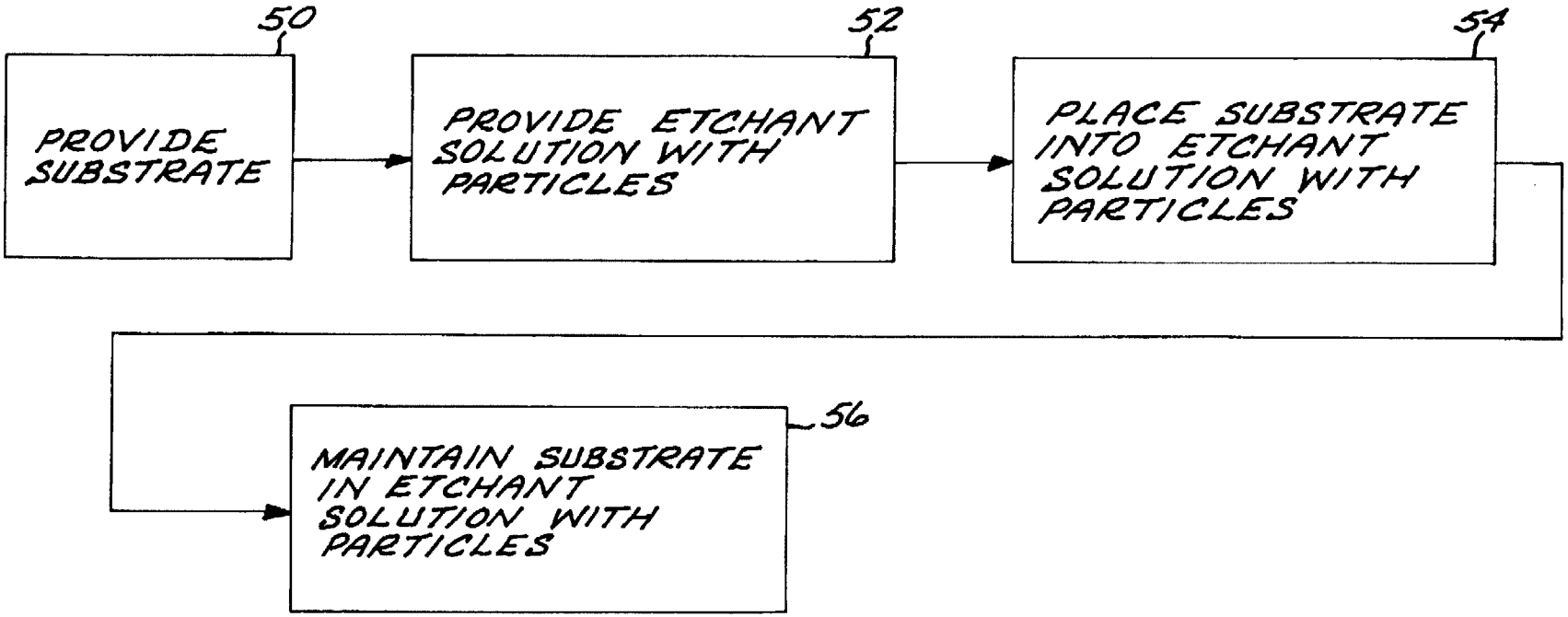
FIG. 3 is a block flow diagram of the approach of the invention.

FIG. 3 is a depiction of the method used in practicing the invention. The substrate is provided, numeral 50. The etchant solution with finely particles distributed therein is provided, numeral 52. The etchant solution is preferably stirred so that the particles are briefly suspended in the solution, and the substrate is placed into the etchant solution with particles therein, numeral 54. In those cases where there is an apertured mask on the surface of the substrate, the substrate is oriented so that the particles will lie in the apertures. The particles thereafter settle onto the surface of the substrate and the mask, as shown in FIG. 2. Gas evolution during etching thereafter aids in stirring the particles. Equivalently for the present purposes, the particles can be sprinkled onto the surface of the substrate before it is immersed into the etchant solution, and carefully lowered into the solution so that the particles are not displaced, or sprinkled onto the surface of the substrate after it has been immersed into the etchant solution. The substrate is thereafter maintained in contact with the etchant solution containing the finely divided, electrically conductive particles, numeral 56, for a period of time sufficient to achieve the desired degree of etching, as measured by the depth of the recess 42. When the desired depth of etching has been reached, the substrate is removed from the etchant solution, and any etchant solution and particles remaining on the surface of the substrate and in the recess are washed off. The process is highly reproducible, so that the etching performance is usually determined in a series of preliminary tests and recorded as a graph of etching depth of the recess as a function of time under constant conditions.

Figure 4:
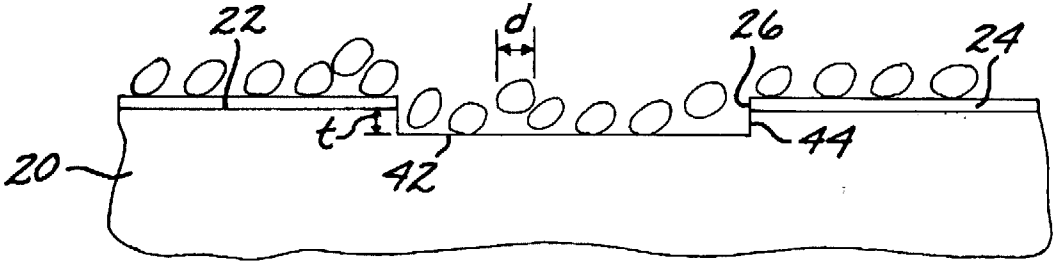
FIG. 4 is a schematic sectional view of the substrate being etched in another embodiment of the invention.

In the embodiment of FIG. 2, the particles 40 are depicted as being smaller than the depth of the recess 42. In another embodiment shown in FIG. 4, the diameter d of the particles 40 is greater than the depth t of the recess 42, where t is measured from the surface 22, below the mask 24, to the bottom of the recess 42. Where the diameter of the particles 40 is greater than the depth of the recess, the particles cannot penetrate under the mask 24 at the sides 44 of the recess 42, and therefore cannot contribute to any undercutting action. This embodiment serves to further reduce the possibility of undercutting.

The present invention has been reduced to practice using the preferred materials and techniques discussed above. A 4-inch diameter piece of silicon substrate was masked with an aperture opening of 3.5 inches diameter. Graphite particles having a size of from about 0.0005 to about 0.003 inches were sprinkled onto the surface of the substrate, and the substrate was immersed into a 10 percent concentration aqueous potassium hydroxide solution maintained at 100° C. As a control, the same procedure was repeated, except that no graphite particles were introduced into the etchant solution. The etching rate when the graphite particles were present was measured to be 0.0035 inches per hour, and the etching rate when no graphite particles were present was measured to be about 0.007 to about 0.009 inches per hour. The presence of the particles resulted in an increased etching rate of about a factor of four. When the etching experiment was repeated with fresh substrates and etchant at a temperature of about 80° C., the etching rate with carbon particles present surprisingly increased to about 0.0055 inches per hour, and the etching rate without carbon particles present decreased to a very low value.

After etching was complete, the etched substrates were removed from their respective etching solutions. The substrates were sectioned, and the profiles of the recesses were analyzed. Undercutting was reduced by about a factor of five when the carbon particles were present, as compared with the case when no carbon particles were present.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for etching a substrate, comprising the steps of:

providing an electrically conductive substrate;

providing an etchant solution;

adding finely divided, electrically conductive particles to the etchant solution, the electrically conductive particles being made of a material that is cathodic to the substrate on a galvanic series and does not dissolve into the etchant solution;

placing the substrate into the etchant solution having the electrically conductive particles therein so that the particles contact the substrate; and maintaining the substrate in contact with the etchant solution having the electrically conductive particles therein for a period of time.

2. The method of claim 1, wherein the step of providing an electrically conductive substrate includes the steps of providing a piece of substrate, and providing an apertured mask over the substrate.

3. An etched substrate prepared by the method of claim 2.

4. The method of claim 1, wherein the step of adding finely divided, electrically conductive particles includes the step of providing electrically conductive particles having a size greater than an etching thickness dimension, and wherein the step of maintaining the substrate includes the step of maintaining the substrate in contact with the etchant solution having the electrically conductive particles therein for a time such that an amount of substrate material is removed from the substrate in a thickness no greater than the etching thickness dimension.

5. The method of claim 1, wherein the step of adding finely divided, electrically conductive particles includes the step of adding particles of electrically conductive carbon.

6. The method of claim 1, wherein the step of adding finely divided, electrically conductive particles includes the step of adding particles of graphite.

7. A method for etching a substrate, comprising the steps of: providing an electrically conductive substrate having an apertured mask thereover;

providing an etchant solution having finely divided, electrically conductive particles mixed therein, the electrically conductive particles being made of a material that is cathodic to the substrate on a galvanic series and does not dissolve into the etchant solution;

placing the substrate into the etchant solution having the electrically conductive particles therein so that the particles contact the substrate; and maintaining the substrate in contact with the etchant solution having the electrically conductive particles therein for a period of time.

8. The method of claim 7, wherein the step of providing an electrically conductive substrate includes the step of providing a substrate having an etching surface made of silicon.

9. The method of claim 8, wherein the step of providing an etchant includes the step of providing a potassium hydroxide solution.

10. The method of claim 7, wherein the step of providing an etchant solution includes the step of heating the etchant solution.

11. The method of claim 7, wherein the step of providing an etchant solution includes the step of adding particles of electrically conductive carbon to the etchant solution.

12. The method of claim 7, wherein the step of providing an etchant solution includes the step of adding particles of graphite to the etchant solution.

13. The method of claim 7, wherein the steps of placing the substrate and maintaining the substrate are accomplished without applying any externally imposed voltage to the substrate.

14. An etched substrate prepared by the method of claim 7.

* * * * *